US005409372A

United States Patent [19]

Nobuo

[11] Patent Number: 5,409,372

[45] Date of Patent: Apr. 25, 1995

[54] GAS LIGHTER WITH SAFETY DEVICE

[75] Inventor: Yamazaki Nobuo, Shizuoka, Japan

[73] Assignee: Tokai Corporation, Kanagawa, Japan

[21] Appl. No.: 974,265

[22] Filed: Nov. 10, 1992

[30] Foreign Application Priority Data

Dec. 9, 1991 [JP] Japan ..... 3-324403

[51] Int. Cl.[6] ..... F23D 11/36

[52] U.S. Cl. ..... 431/153; 431/277

[58] Field of Search ..... 431/153, 277; 222/153, 222/402.11

[56] References Cited

U.S. PATENT DOCUMENTS

| | | | |
|---|---|---|---|
| 2,520,328 | 8/1950 | Nissen | 431/153 X |
| 3,898,031 | 8/1975 | Rusakowicz | 431/153 X |
| 4,784,602 | 11/1988 | Nitta | 431/153 |
| 4,786,248 | 11/1988 | Nitta | 431/255 |
| 4,830,603 | 5/1989 | Cirami | 431/277 X |
| 4,832,596 | 5/1989 | Morris, Sr. | 431/277 X |
| 4,859,172 | 8/1989 | Nitta | 431/153 |
| 4,921,420 | 5/1990 | Johnston | 431/153 |
| 5,002,482 | 3/1991 | Fairbanks et al. | 431/277 |
| 5,090,893 | 2/1992 | Floriot | 431/153 |
| 5,120,215 | 6/1992 | Amoros Nollas | 431/153 |
| 5,165,886 | 11/1992 | Frigiere | 431/277 X |
| 5,228,849 | 7/1993 | Frigiere | 431/153 X |
| 5,242,297 | 9/1993 | Cirami | 431/277 X |

FOREIGN PATENT DOCUMENTS

| | | |
|---|---|---|
| 1-178456 | 10/1989 | Japan . |
| 3-25215 | 2/1991 | Japan . |
| 3-501647 | 4/1991 | Japan . |
| 3-35971 | 7/1991 | Japan . |

*Primary Examiner*—Carl D. Price

*Attorney, Agent, or Firm*—Brumbaugh, Graves, Donohue & Raymond

[57] ABSTRACT

A gas lighter with a safety device has a lock member pivotal between a locked position, where it prevents depression of an ignition, and a released position, where it allows depression of an actuating lever. The lock member is constantly urged to the locked position by means of a spring. The lock member has also a finger board extending outside a lighter body and being positioned where it can be depressed with the same finger as is used in depressing the actuating lever, and a stopper being movable between the locked position, in response to movement of the lock member in one direction, and the released position, in response to movement of the lock member in the other direction. When the lighter is not in use, the lock member is urged to the locked position to make an abutment against an abutment portion on the lighter body, thereby preventing depression of the actuating lever. When the lighter is in use, depressing the finger board causes pivotal movement of the lock member, thereby resulting in the lock member held in the released position by an engagement of engaging portions. Depressing the actuating lever permits the return of the lock member to the initial position.

7 Claims, 4 Drawing Sheets

GAS LIGHTER WITH SAFETY DEVICE

BACKGROUND OF THE INVENTION

1. Field of the Invention

This invention relates to a gas lighter with a safety device and, more particularly to, a so-called child resistant gas lighter with a safety device for prohibiting depression of an actuating lever of the lighter so as to prevent inadvertent ignition while the gas lighter is not in use.

2. Description of the Prior Art

Though a gas lighter is a convenient tool which can easily be ignited by the depression of the actuating lever, it can be a safety hazard for those who, like children, do not know the proper use of the lighter.

There have been proposed various types of child resistant gas lighters. Most of the safety devices built into these child resistant gas lighters have a lock mechanism which prevents depression of the actuating lever and which must be released to allow the actuating lever to be depressed. However, any of the conventional-type child resistant gas lighters will have drawbacks in their usage and thus it is desirable that the gas lighter be improved for practical use.

For instance, as disclosed in U.S. Pat. Nos. 4,859,172, 4,786,248, and 4,784,602 and Japanese Utility Model Publication No. 3(1991)-35971, any one of the disclosed safety devices is provided with a lock member for deterring depression of the actuating lever. Since the lock member is manually movable between a locked position and a released position, the lock member tends to stay at the released position without a manual recovery from the released position to the initial position after the use of the lighter, whereby the safety device remains unlocked. Leaving the lock member at the released position permits the actuating lever to be depressed, rendering the safety device inoperable. Specifically then, to ensure safety, the existing safety devices always require a manual relocking operation after the use of the lighter with the lock mechanism unlocked, and hence there were expected further improvements of the lock mechanism in terms of safety.

To solve the drawbacks set forth above, there have been proposed, as a safety device having a lock member to impede the depression of the actuating lever, safety devices with what is called an auto-return function wherein the lock member automatically returns to the locked position in response to the ignition operation after the lock member has been manually moved to the released position. U.S. Pat. Nos. 5,002,482, and 3,898,031, and Japanese Unexamined Patent Publication No. 3(1991)-25215, for instance, disclose such safety devices as having the auto-return function which allows automatic return of the lock member to the locked position in response to the ignition operation. With these safety devices, however, releasing the lock mechanism is only achieved by the motion of a finger along an L-shaped path, thereby resulting in the lock mechanism being inferior, in terms of operability, in the ease of releasing the lock member such that a lighter of this type generally requires operation with a single finger, such as a thumb, thus leading to different results depending on the users. Therefore, safety devices of this type can be said to be disadvantageous in practical use. Further, the operation of these safety devices is unreliable because of a probability that the lock member will return to the locked position by its own reactive force which is due to the resilience of the material constituting the lock member.

Furthermore, there have been proposed safety devices wherein the lock member is released by the motion of a finger not along the L-shaped path, but along a simple linear path, but any of those have drawbacks in practical use. The safety device as disclosed in Japanese Patent Publication of Translated Version (PCT) No. 3(1991)-501647, for instance, is provided with an automatic return function wherein the part of a lock member being composed of a spring is moved along an arcuate path to the released position and held there, then it automatically returns to the locked position in response to the ignition operation. In this type of safety device, the arrangement for guiding the release of the spring-like lock member is not satisfactory, and accordingly the lock member cannot be steadily released. This adversely affects the ease of releasing the lock mechanism in the gas lighter, which is generally operated with a single finger, and, as with the preceding example, the resulting operations will be different depending on the users. Since the lock member itself is formed of a spring, the lock member may become deformed and cause failure of the lock mechanism after repeated use of the lighter.

In the safety device disclosed in U.S. Pat. No 4,832,596, the lock member is moved to the released position along a linear path, but automatically returns to the initial position unless it is held at the locked position with a finger other than the one used for actuating the ignition mechanism. Thus, the lock member cannot steadily be released. This adversely affects the ease of releasing the lock mechanism in a gas lighter, which is generally operated with a single finger, e.g. the thumb, and, as with the preceding examples, leads to different operational results depending on the users.

In order to overcome such problems, there has been proposed an auto-return safety device in which the lock member is moved along a linear path to the released position, thereby facilitating the release of the lock mechanism, and at the same time, the lock mechanism can be held in the released position with the finger which actuates the ignition mechanism, thus not requiring another finger. However, the safety device also has drawbacks in its practical use. That is, in the safety device disclosed in Japanese Unexamined Utility Model Publication No. 1(1989)-178456,the lock member is incorporated in the actuating lever which is actuated to ignite the lighter and the actuating lever can be operated with use of the same finger that has been used in releasing the lock member, i.e. the thumb which is generally used in an ignition operation, thus facilitating the releasing operation. However, when the actuating lever is actuated with the same finger (usually the thumb) which previously moved the lock member to the released position, the lock member may inadvertently be released from the thumb land may return to the locked position. Accordingly, also in this safety device, the lock member cannot be steadily released. This adversely affects the ease of releasing the lock mechanism in the gas lighter, which is generally operated with a single finger, e.g. the thumb, and, as with the preceding examples, this leads to different operational results depending on the users.

As can be seen from the description above, any one of the existing child resistant safety devices has drawbacks in practical use, and hence there has been a demand for a child resistant safety device which is improved in both safety and operability.

Further, in manufacturing gas lighters with such a safety device, it is required to rationalize the assembling steps, to improve assembling accuracy, thereby further enhancing the handling of the safety device, and to reduce the manufacturing cost.

SUMMARY OF THE INVENTION

In view of the forgoing observations and description, the primary object of the present invention is to provide a gas lighter with a safety device, that is excellent in terms of safety and ease of handling. The lighter has an auto-return function which allows automatic resetting of a lock mechanism without requiring a relocking operation, after the use of the gas lighter; and the lighter is enhanced in its ease of handling in that releasing a lock member along a simple path allows releasing of the lock mechanism. Moreover, in this gas lighter, a temporary holding of the lock member at the released position is accomplished by the release of the lock mechanism by moving the lock member with the finger to be used for the ignition operation. Thus, the gas lighter with the safety device, according to this invention, is aimed at assuring operational results satisfactory to every user.

Another object of the present invention is to provide a gas lighter with a safety device which is further improved in stability while in the locked state.

Still another object of the present invention is to provide a gas lighter with a safety device which permits rationalization of the assembling steps, improvement of accuracy when assembling the safety device, thereby further ,enhancing the handling of the safety device, and reduction of the manufacturing cost.

In accordance with one aspect of the present invention, there is provided a gas lighter with a safety device having a lighter body in which are provided a fuel reservoir for containing fuel and a fuel supply means for supplying fuel from the fuel reservoir at a regulated flow rate, an igniting means for igniting the supplied fuel, and an actuating lever which, in response to depression by an external force, actuates the fuel supply means to inject the fuel supplied from the fuel reservoir, wherein the improvement comprises:

an abutment portion on the upper portion of the lighter body including an abutment surface and a recess, both being situated below a depressed portion of the actuating lever, a lock member, positioned below the actuating lever, including a finger board and a stopper, the finger board being supported pivotally under an urging force and projecting outwards, and the stopper projecting downwards and rocking between a locked position above the abutment surface, and a released position above the recess, a holding means for retaining at the same position the lock member, having been moved to the released position, and a releasing means for releasing the lock member from the released position by liberating the holding means when a depressing stroke of the actuating lever approaches near to the bottom thereof.

The abutment surface and the recess of the abutment portion can be constituted integrally on the upper portion of the lighter body.

Specifically, the holding means is composed of a protrusion and a recess which are engaged with each other when the lock member is situated at the released position, and either the protrusion or the recess can be formed on a side face of the lock member, whilst the other is formed on an inside face of the side walls of the depressed portion, the latter surface being opposite to the former. As a matter of course, either the protrusion or the recess can be formed not only on the side surface of the lock member orthogonal to the pivot of the same, but also on a surface that is parallel with the pivot and located on one of the opposite sides of the pivot distant from the finger board portion.

Moreover, the releasing means can be a protrusion or a projection formed on one part of the lock member where an abutment of the projection against the abutment surface of the lighter body, when a depressing stroke of the actuating lever approaches near to its bottom, causes angular movement of the lock member so as to disengage the protrusion from the recess.

The means for urging the lock member into the locked position can be constituted of a spring member such as a leaf spring, a helical spring, a clip spring, or the like. However, the spring will be unnecessary if the lock member itself can perform a rotative correction into the locked position by means of its weight. In such a case, the weight of the lock member can be considered as a means for urging the lock member into the locked position.

As another embodiment, the finger board portion and the releasing projection may be integrated into a single protrusion on the lock member.

In particular, in accordance with another aspect of this invention, there is provided a gas lighter with a safety device comprising:a fuel reservoir for containing fuel, a fuel supply means for supplying fuel from said fuel reservoir at a regulated flow rate, an ignition means for igniting the supplied fuel, an actuating lever which is depressible by an external force and which activates in response to the depression said fuel supply means to inject the fuel supplied from said fuel reservoir, a lighter body in which is provided said fuel reservoir and at the upper portion thereof being disposed said fuel supply means, said ignition means and said actuating lever, an abutment portion formed on the upper portion of said lighter body and being composed of an abutment surface and a recess, both said abutment surface and said recess being situated below a depressed portion of said actuating lever, a lock member, pivotally supported below said depressed portion of said actuating lever, having a stopper, said stopper rocking between a locked position in which said stopper is positioned above said abutment surface of said lighter body in response to the pivotal movement of said lock member and a released position above said recess in which insertion of said stopper into said recess permits depression of said actuating lever, an urging means for resiliently urging said lock member to said locked position;

an engaging portion for the holding use being provided on a inside face of said actuating lever which is adjacent and opposite to a side surface of said lock member, and being engaged with a part of said lock member having been moved to said released position with a given amount of force or less to hold said lock member at said released position;

a finger board portion being a part of said lock member to project outwards, and being arranged so as to be depressed with the same finger as used for pushing down said actuating lever; and a protrusion for the releasing use being formed in such a manner as to make an abutment against said abutment surface of said lighter body to permit pivotal movement of said lock member towards said locked position in response to depression of said actuating lever when said lock member is held in said released position.

According to the safety device of this invention, when the lighter is not; in use, the lock member hinders depression of the actuating lever, providing a constant prevention of inadvertent ignition, whereas, when the lighter is used, movement of the lock member to the released position by the releasing operation allows ignition of the lighter. After the ignition, elevation of the actuating lever entails automatic return of the lock member to the locked position; namely, there is assured a so-called auto-return function, in which the lock mechanism is automatically reset without a relocking operation after the lighter has been used with the lock mechanism released, thereby realizing a gas lighter extremely safe.

Since the lock member is only moved between the locked position and the released position along a simple path, the operation of the lock member is facilitated, thereby leading to a lighter enhanced in ease of handling.

Automatic holding of the lock member in the unlocked position allows operation of the actuating lever with the same finger previously used in releasing the actuating lever independently of the releasing operation, thereby resulting in a lighter improved in both safety and ease of handling and hence assuring operational results equal for every user.

Integrating components of the safety device into a single lock member facilitates assembling of the device in the manufacturing process and permits rationalization of the same, thereby reducing the production cost.

With the lock member being urged to the locked position, the presence of the lock member between the depressed portion of the actuating lever and the lighter body results in an improvement of the stability in the locking state.

No modifications having been made on the shape of the tank assures the unit strength of the tank.

DETAILED DESCRIPTION OF THE PREFERRED EMBODIMENTS

Referring to accompanying drawings, preferred embodiments of this invention will be described hereunder in detail. FIGS. 1 through 4 represent a gas lighter with a safety device according to a first embodiment of this invention.

Figure 1:
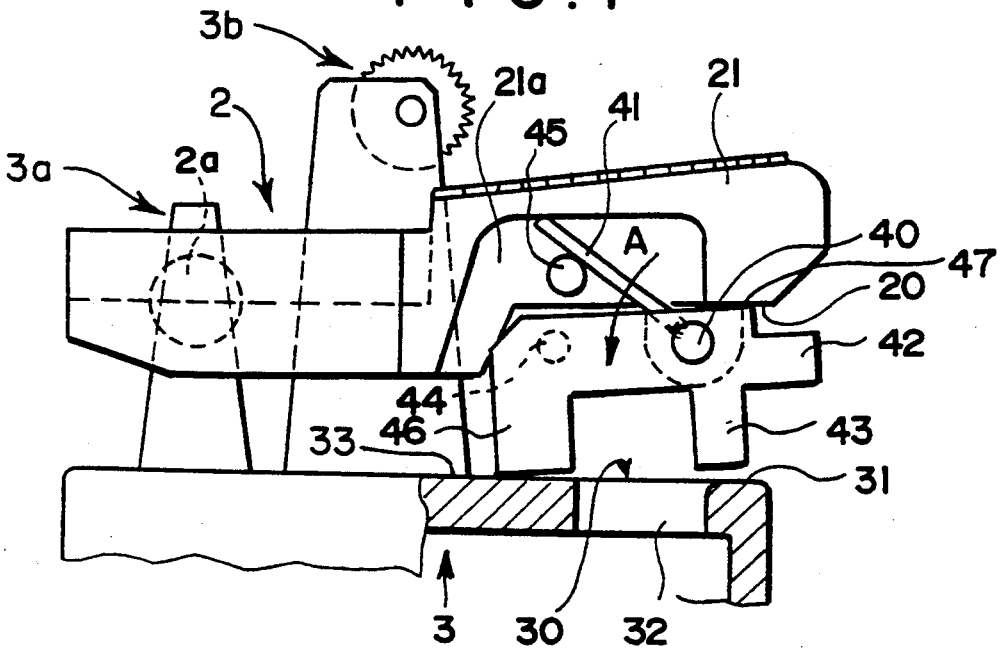
FIG. 1 is a fragmentary side cross-sectional view showing chief elements of a gas lighter with a safety device according to this invention in the locked state.

FIG. 1 illustrates the gas lighter with the safety device, according to the first embodiment, unused; namely, an actuating lever 2 unlocked.

The gas lighter with the safety device, according to this invention, is chiefly comprised of a lighter body 3 including a non-illustrated existing fuel reservoir for containing fuel to be ignited and a schematically-illustrated conventional ignition means **3*b* for igniting the supplied fuel; and an actuating lever 2** which, in response to depression by an external force, actuates the fuel supply means to inject the fuel supplied from the fuel reservoir.

On the upper portion of the lighter body 3 is provided an abutment portion 30, consisting of an abutment surface 31 and a recess 32, below a depressed portion 21 of the actuating lever 2.

Below the depressed portion 21 of the actuating lever 2 is disposed a Lock member 4 in such a manner as to be pivotal and urged by the force of a leaf spring 41 in one rotative direction around a pivot 40 designated by the arrow A. This lock member 4 is composed of a finger board portion 42 which extends out from the lock member and is positioned where it can be depressed with the finger (thumb) to be used for suppressing the depressed portion 21 and a stopper portion 43 extending downward from the lock member, the stopper portion being moved to a locked position (shown in FIG. 1), above the abutment surface 31, when the lock member is angularly moved in the rotative direction by the urging force of the leaf spring 41 whilst being moved to a released position (shown in FIG. 2), above the recess 32, when the lock member is forced in another rotative direction.

Figure 2:
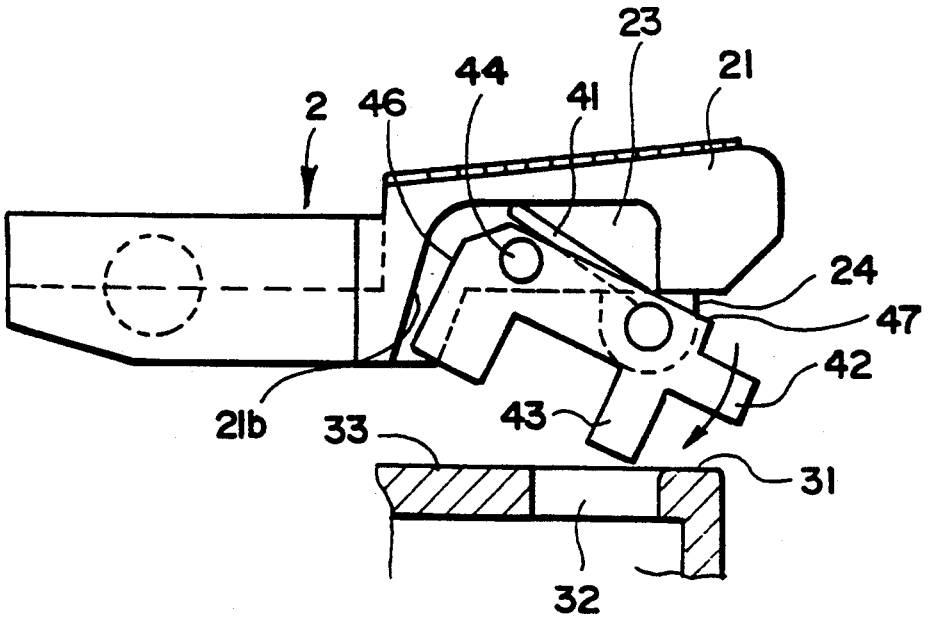
FIG. 2 is a fragmentary side cross-sectional view showing the chief elements shown in FIG. 1 in the released state.

As a means for holding, at the released position, the lock member 4 shown in FIG. 2 that has been moved to the released position, there is further provided an engaging portion consisting of an engaging protrusion 44 and an engaging recess 45 which are engaged with each other when the lock member 4 is situated in the released position. More specifically, the holding means includes the engaging protrusion 44 formed on a side surface **4*a* of the lock member 4 and the engaging recess provided on one side wall of the depressed portion 21 of the actuating lever 2, the side surface 4*a* being opposite to the side wall. These protrusions and recesses are engaged with each other when the lock member 4 is held in the released position as shown in FIG. 2, whilst they are disengaged when the lock member 4 stays in the locked position as shown in FIG. 1**.

Figure 3:
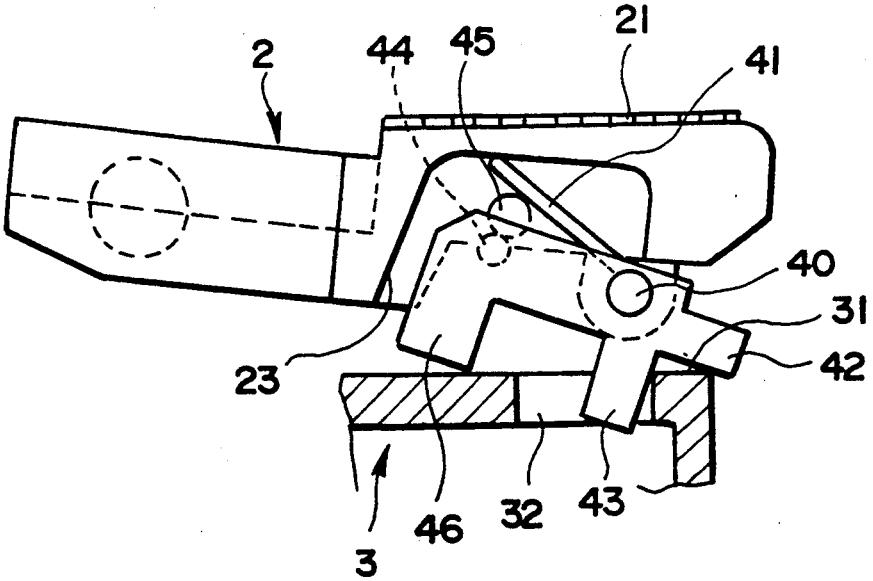
FIG. 3 is a fragmentary side cross-sectional view showing the chief elements shown in FIG. 1 in the transferring state wherein the elements are moving from the released position to the locked position.

The lock member 4 further comprises a releasing means for unlocking the lock member 4 retained in the held position by disengaging the holding means when a depressing stroke of the actuating lever 2 approaches near to its bottom. As one specific exemplary structure of this releasing means, it may be considered either a protrusion or a projection formed on one part of the lock member 4 in such a manner that abutment of the projection against a part of the lighter body 3 when the depressing stroke of the actuating lever 2 approaches near to its bottom, causes the lock member 4 to be rotated so as to disengage the protrusion 44 from the recess 45. As being explicit from FIGS. 1 through 4, this releasing means also acts as a finger board 42 which projects from a part of the lock member 4 at a position where it can be depressed with the finger (thumb) for pushing down the depressed portion 21. The releasing means is constituted on one part of the lock member 4 in such a manner that abutment of the bottom surface of the finger board 42 against the abutment surface 31 of the lighter body 3, as shown in FIG. 3, causes elevation of the finger board 42 in response to the depression of the actuating lever 2, i.e. pivotal movement of the lock member 4 toward the locked position.

According to this embodiment, the lock member 4 is also provided with a leg portion 46, as a holding means, which extends down from the lock member and is located at a position inwardly remote from the pivot 40. In the locking state as shown in FIG. 1, this leg portion 46 securely holds the lock member 4 at the locked position with an abutment against a top surface 33 of the lighter body 3, and acts as a weight when the lock member 4 is recovered from the released state, as shown in FIG. 2, to the locking state, as shown in FIG. 1, via the transitional state, as shown in FIG. 3. This leg portion 48 is, however, not a requisite because in the locking state of FIG. 1 a shoulder 47 of the lock member 4, instead of the leg, depicted right top in FIG. 1, upholds the lock member 4 in the locked position with an abutment against the bottom surface 20 of the actuating lever 2.

Figure 4:
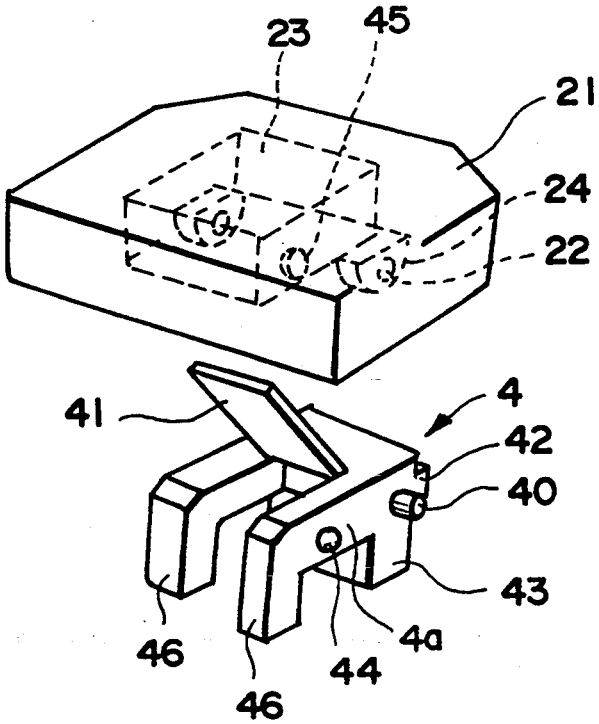
FIG. 4 is an exploded perspective view showing a depressed portion of an actuating lever and a lock member, both constituting the safety device.

Under the bottom surface of the depressed portion 21 of the actuating lever 2 is shaped a recess 23 as designated by a dotted line of FIG. 4. In this recess, the leaf spring 41 is incorporated with an abutment against the recess, and on the internal surface of the recess is formed the engaging recess 45 of the holding means which is engaged with the protrusion 44 on the lock member 4.

Figure 5:
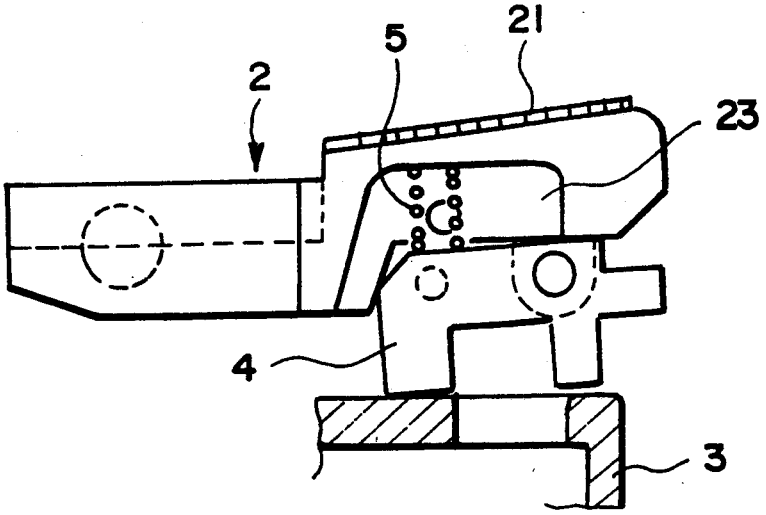
FIG. 5 is a fragmentary side cross-sectional view showing chief elements of a gas lighter with a safety device according to another embodiment of this invention in the locked state.
Figure 6:
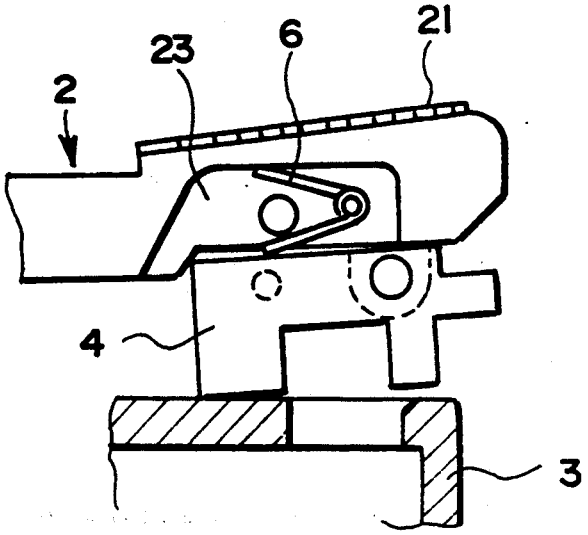
FIG. 6 is a fragmentary side cross-sectional view showing chief elements of a gas lighter with a safety device according to still another embodiment of this invention in the locked state.

As another embodiment of the mechanism for urging the lock member 4 from the released position to the locked position, instead of the leaf spring 41 disposed on the lock member 4, inside the recess 23 can be provided either a helical spring 5 or the clip spring 6 as shown in FIG. 5 or 6 in such a manner as to be sandwiched between the bottom surface of the recess 23 and a top surface of the lock member 4.

The principle operation of the gas lighter, according to the embodiments, having the structure set forth in the above will now be described in detail.

When the lighter is not used, as shown in FIG. 1, the finger board portion 42 of the lock member 4, which also serves as the releasing projection, is situated at its peak of the stroke, and the stopper 43 is held in the locked position to make an abutment against the abutment surface 31 on the top of the lighter body. The presence of the stopper 43 between the actuating lever 2 and the abutment surface 30 of the lighter body 3 hinders depression of the actuating lever 2. Accordingly, the lighter cannot be ignited in this state, thereby preventing inadvertent ignition by children.

When the lighter is in use, depressing the finger board portion 42 of the lock member 4, which also serves as the releasing projection, in the direction designated with an arrow as shown in FIG. 2 against the urging force of the leaf spring 41 causes movement of the lock member 4 from the locked position to the released position, allowing the actuating lever 2 to be depressed. In practice, since the stopper 43 of the lock member 4 departs from the abutment surface 31 of the abutment portion 30 on the lighter body to above the recess 32, from which the stopper enters the recess, the absence of the stopper 43 allows depression of the actuating lever 2. At this moment, the protrusion 44 of the holding means is engaged with the recess 45, so that the lock member 4 is retained in the released position.

Pressing the actuating lever 2 entails insertion of the stopper 43 into the recess 32, which is a part of the abutment portion 30, and hence permits depression of the actuating lever 2, releasing gas to be burned by the ignition device.

In short, depressing the actuating lever 2 causes ignition of the lighter. With the lock member 4 held in the released position, when the actuating lever 2 is depressed, the finger board portion 42, also serving as the releasing projection makes an abutment against the top portion, or the abutment surface 31, of the lighter body 3 as illustrated in FIG. 3, so that the lock member 4 is angularly moved to the locked position in response to depression of the actuating lever 2. This results in disengagement of the protrusion 44 from the recess 45 as shown in FIG. 3. After departing from the released position, although the lock member 4 tends to return to the locked position due to the compressing force of the spring that has urged the lock member 4, the stopper 43 makes an abutment against a side wall of the recess 32 of the lighter body.

Upon release of the actuating lever 2 after completion of the ignition of the lighter, the actuating lever 2 is elevated and the stopper 43, being held in the recess 32, is disengaged, whereby the lock member 4 is returned to the locked position shown in FIG. 1 by the force of the spring (leaf spring) 41 of the lock member 4.

Thus, according to this invention, when the lighter is not used, the presence of the lock member 4 inhibits depression of the actuating lever 2, thereby preventing inadvertent ignition. At the time of ignition, movement of the lock member to the released position permits ignition of the lighter. After the ignition, elevation of the actuating lever 2 entails automatic resetting of the lock member to the locked position. Eventually, after the use of the lighter with the lock mechanism unlocked, the lock mechanism is automatically activated without a relocking operation, resulting in a child resistant type gas lighter with high safety.

Though, according to the above-mentioned embodiments, wherein the pivot 40 of the lock member 4 is placed parallel to the shaft **2*a* and the finger board portion 42 of the lock member 4 is positioned below the actuating lever 2, the pivot 40 of the lock member 4 can be disposed at right angles relative to the shaft 2*a* of the actuating lever 2 and the finger board 42 of the lock member 4 can be disposed below either of the side walls of the actuating lever 2**.

The embodiments described above are merely representations of the specific examples, and, as a matter of course, the present invention is susceptible to various modifications, changes and adaptations.

As can be seen from the above, the details of the present invention can be embodied in various ways, and the embodiments set forth may be modified into a number of forms.

The type of lighter according to this invention is not limited, and hence the safety device employed in this invention can be adapted not only to the flint type but to a piezoelectric type, an electronic type, or the like.

Though the above embodiments employ the spring member, such as a leaf spring, a helical spring or a clip spring, as the means for resiliently urging the lock member to the locked position, the spring member need not be limited to a spring because the leg portion 46 of the lock member 4, as previously mentioned, performs a pivotal correction to the locked position with its weight. In this case, the weight of the lock member can be regarded as the urging means.

In the embodiments, on the side surface 4*a* of the lock member 4 and the wall 21*a* of the depressed portion 21 of the actuating lever 2 are provided the protrusion 44 and the recess 45 which are arranged in such a manner as to be engaged with each other, when the lock member 4 is held in the release position, as the means for holding the lock member 4 that has been moved to the released position. The side surface 4*a* of the lock member, upon which the protrusion 44 is provided, includes not only the plane being normal to the pivot 40 of the lock member 4, but a plane being parallel to the pivot, e.g. a plane 4*b* positioned on one of the sides of the pivot distant from the finger board portion shown in FIG. 2. With such an arrangement, the engaging recess 45, which is engaged with the protrusion 44, is formed on an inside wall 21*b*, which is opposite to the plane 4*b* under the bottom of the depressed portion 21 of the actuating lever 2.

Figure 7:
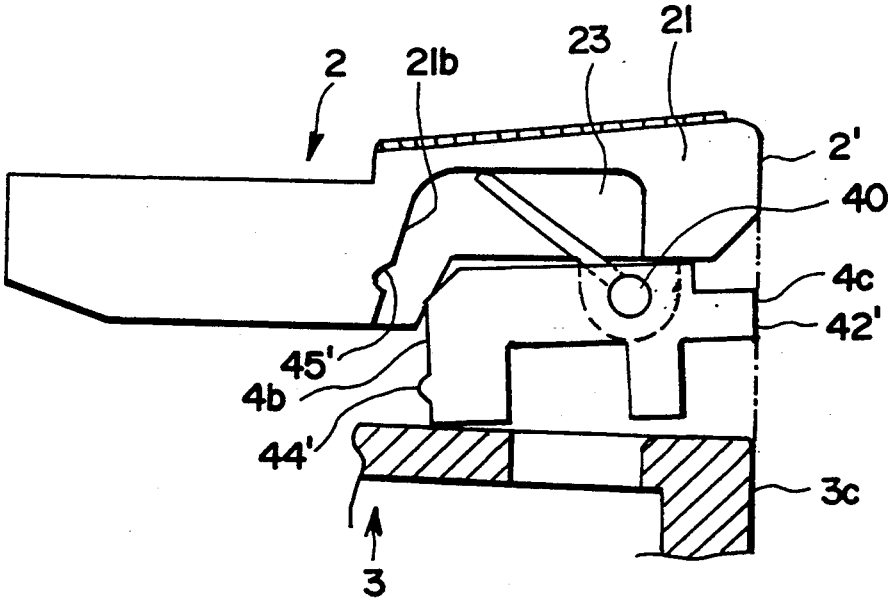
FIG. 7 is a fragmentary side cross-sectional view showing chief elements of a gas lighter with a safety device according to a further embodiment of this invention in the locked state.

FIG. 7 schematically represents an alternative arrangement of the embodiments mentioned above. In this arrangement, a protrusion 44', acting in the same manner as the protrusion 44, is formed on a plane orthogonal to the pivot 40 of the lock member 4, i.e. the side surface 4*b* on one of the sides of the pivot distant from the finger board portion 42. Meanwhile, a recess 45', which is engaged with the protrusion 44', is provided on the inside wall 21*b* under the bottom surface of the depressed portion 21 of the actuating lever 2, the inside wall being opposite to the side surface.

In the embodiment shown in FIG. 7, since the plane 2' of the actuating lever 2, the plane 42*c* of the finger board 42', and the plane 3*c* of the lighter body 3 are arranged in a coplanar manner, the lighter can be smoothly taken in and out of the pocket without a catch due to a projection of the lighter.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent from persons skilled in the art.

What is claimed is:

1. A gas lighter with a safety device having a lighter body in which are provided a fuel reservoir for containing fuel and a fuel supply means for supplying fuel from the fuel reservoir at a regulated flow rate, an igniting means for igniting the supplied fuel, and an actuating lever which, in response to depression thereof by an external force, actuates the fuel supply means to inject the fuel supplied from the fuel reservoir, wherein the improvement comprises, an abutment portion formed on an upper surface of said lighter body and a recess in the upper surface adjacent to the abutment portion, both the abutment portion and the recess being situated adjacent to said actuating lever, a lock member provided between said actuating lever and said abutment portion, said lock member being supported for rotation with respect to the actuating lever and for motion toward the upper surface of the lighter body in response to depression of the actuating lever and including a finger board and a stopper and being movable between a lock position where said stopper is located on said abutment surface to prevent the depression of said actuating lever and a release position where said stopper is located over said recess to allow depression of said actuating lever, and said lock member being spring-biased toward said lock position, said finger board projecting outward with respect to the lighter body to be operated by a finger so as to move said lock member from said lock position to said release position, a holding means for holding said lock member in said release position, and a releasing means for releasing said lock member from said release position by releasing said holding means when a depressing stroke of said actuating lever approaches the bottom thereof.

2. A gas lighter with a safety device as defined in claim 1, wherein said abutment surface and said recess of said abutment portion are integrally formed on the upper portion of the lighter body.

3. A gas lighter with a safety device having a lighter body in which are provided a fuel reservoir for containing fuel and a fuel supply means for supplying fuel from the fuel reservoir at a regulated flow rate, an igniting means for igniting the supplied fuel, and an actuating lever which, in response to depression thereof by an external force, actuates the fuel supply means to inject the fuel supplied from the fuel reservoir, wherein the improvement comprises, an abutment portion formed on an upper surface of said lighter body and a recess in the upper surface adjacent to the abutment portion, both the abutment portion and the recess being situated adjacent to said actuating lever, a lock member provided between said actuating lever and said abutment portion, said lock member including a finger board and a stopper and being movable between a lock position where said stopper is located on said abutment surface to prevent the depression of said actuating lever and a release position where said stopper is located over said recess to allow depression of said actuating lever, and said lock member being spring-biased toward said lock position, said finger board projecting outward with respect to the lighter body to be operated by a finger so as to move said lock member from said lock position to said release position, a holding means for holding said lock member in said release position, and a releasing means for releasing said lock member from said release position by releasing said holding means when a depressing stroke of said actuating lever approaches the bottom thereof, wherein said holding means is composed of a protrusion and an engaging recess, both being engaged with each other when said lock member is situated at said released position, and either said protrusion or said recess is formed on either a front or a side face of said lock member, while the other is formed on an inside surface of said depressed portion of said actuating lever, said inside surface being opposite to the former.

4. A gas lighter with a safety device as defined in claim 3, wherein said releasing means is an extended portion of said lock member, and makes an abutment against said abutment surface when the depressing stroke of said actuating lever approaches nearby the bottom thereof to entail disengagement of said protrusion and said engaging recess being engaged with each other.

5. A gas lighter with a safety device as defined in claim 3, wherein said abutment surface and said recess of said abutment portion are integrally formed on the upper portion of the lighter body.

6. A gas lighter with a safety device comprising:

a fuel reservoir for containing fuel, a fuel supply means for supplying fuel from said fuel reservoir at a regulated flow rate, an ignition means for igniting the supplied fuel, an actuating lever which is depressible by an external force and activates in response to the depression said fuel supply means to inject the fuel supplied from said fuel reservoir, a lighter body in which is provided said fuel reservoir and at the upper portion thereof being disposed said fuel supply means, said ignition means and said actuating lever, an abutment portion formed on an upper surface of said lighter body and a recess in the upper surface adjacent to the abutment portion, both said abutment portion and said recess being situated adjacent to said actuating lever, a lock member provided between said actuating lever and said abutment portion, and having a stopper which is movable between a lock position where said stopper is located on said abutment portion to prevent the depression of said actuating lever and a release position where said stopper is located over said recess to allow depression of said actuating lever;

an urging means for resiliently urging said lock member to said locked position;

an engaging portion being provided on an inside face of said actuating lever which is adjacent and opposite to a side surface of said lock member, and being engaged with a part of said lock member after the lock member has been moved to said release position to hold said lock member at said release position;

a finger board portion being a part of said lock member to project outwards with respect to the lighter body, and being arranged so as to be depressed with the same finger as is used for pushing said actuating lever; and a protrusion formed to make an abutment against said abutment surface of said lighter body to permit pivotal movement of said lock member towards said lock position in response to depression of said actuating lever when said lock member is held in said release position.

7. A gas lighter with a safety device as defined in claim 6, wherein said finger board and said releasing protrusion constitute a single protrusion integrally formed on said lock member.

* * * * *

UNITED STATES PATENT AND TRADEMARK OFFICE

CERTIFICATE OF CORRECTION

PATENT NO. : 5,409,372

DATED : April 25, 1995

INVENTOR(S) : Nobuo Yamazaki

It is certified that error appears in the above-indentified patent and that said Letters Patent is hereby corrected as shown below:

On the title page, item [19]: "Nobuo" should read --Yamazaki--;

On the title page, Item [75], "Yamazaki Nobuo" should read --Nobuo Yamazaki--;

Title page, item [56], first col., last line, "10/1989" should read --12/1989--;

Column 2, line 58 "land " should read --and--;

Column 5, line 13 "not; in " should read --not in--;

Column 6, line 24 "conventional" should read --conventional fuel supply means 3a for supplying fuel from the fuel reservoir at a controlled flow rate; a schematically-illustrated conventional--;

Column 6, line 34 "Lock" should read --lock--;

UNITED STATES PATENT AND TRADEMARK OFFICE

CERTIFICATE OF CORRECTION

PATENT NO. : 5,409,372

DATED : April 25, 1995

INVENTOR(S) : Nobuo Yamazaki

It is certified that error appears in the above-indentified patent and that said Letters Patent is hereby corrected as shown below:

Column 9, line 48 "plane 42c" should read --plane 4c--.

Signed and Sealed this

Twelfth Day of September, 1995

*Attest:*

*Attesting Officer*

Bruce Lehman

BRUCE LEHMAN

*Commissioner of Patents and Trademarks*